US006104355A

United States Patent [19]

Wilson

[11] Patent Number: 6,104,355

[45] Date of Patent: Aug. 15, 2000

[54] HIGH Q LOADED ANTENNA

[75] Inventor: James W. Wilson, Las Vegas, Nev.

[73] Assignee: Wilson Antenna, Inc., Las Vegas, Nev.

[21] Appl. No.: 09/434,432

[22] Filed: Nov. 4, 1999

Related U.S. Application Data

[63] Continuation of application No. 09/052,780, Mar. 31, 1998.

[51] Int. Cl.[7] ..... H01Q 1/32

[52] U.S. Cl. ..... 343/749; 343/872; 343/895; 343/713

[58] Field of Search ..... 343/715, 872, 343/895, 749, 860, 750, 873, 713

[56] References Cited

U.S. PATENT DOCUMENTS

| | | | |
|---|---|---|---|
| 3,461,455 | 8/1969 | Rowe | 343/749 |
| 4,097,867 | 6/1978 | Eroncig | 343/715 |
| 5,218,372 | 6/1993 | Cheng | 343/749 |
| 5,648,788 | 7/1997 | Bumsted | 343/895 |
| 5,751,251 | 5/1998 | Hutchinson | 343/715 |

*Primary Examiner*—Don Wong
*Assistant Examiner*—James Clinger
*Attorney, Agent, or Firm*—Leon D. Rosen

[57] ABSTRACT

An antenna with loading coil is described, which has an especially high Q for longer range communication. The inside of the coil is left empty of solid material while a frame that surrounds the coil is of dielectric material. The wire that forms the coil is constructed so upper and lower wire portions that extend radially inwardly from the ends of the coil, extend at inclines much greater than the wind angle of the coil, and hold metallic coupling slugs away from the opposite ends of the coil. Strips of silicone extend between adjacent coil turns and are mounted on the coil, to minimize vibrations while using a minimum of dielectric material close to the coil. By combining these improvements into a practical commercial coil, applicant has raised the coil Q by 29.5% from the Q of his previous antenna which had the highest Q of citizen band antennas on the market.

6 Claims, 3 Drawing Sheets

FIG. 3
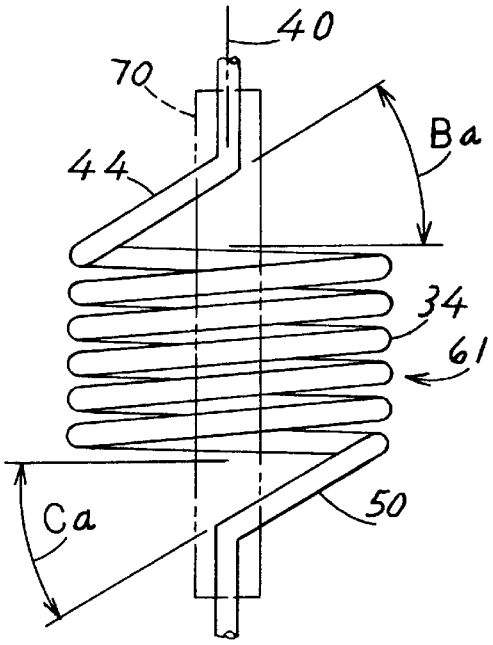
FIG. 6
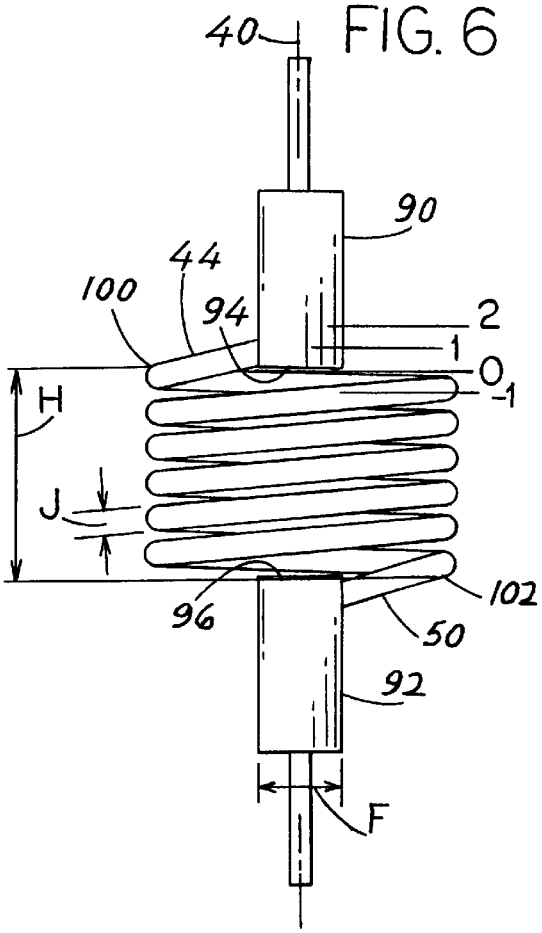
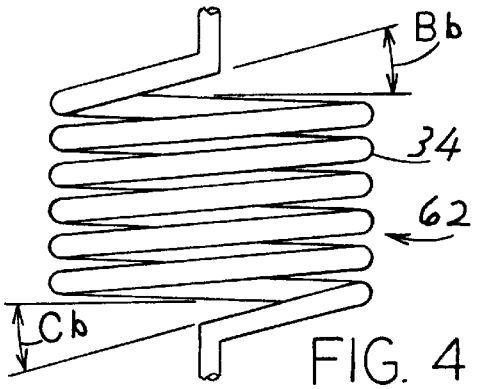
FIG. 4
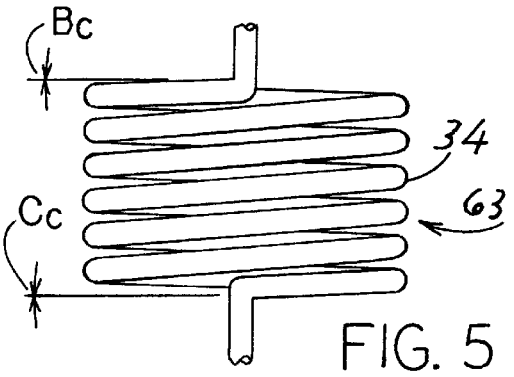
FIG. 5
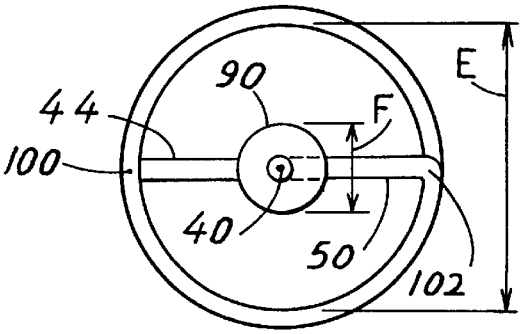
FIG. 7

HIGH Q LOADED ANTENNA

This is a CONTINUATION of co-pending application Ser. No. 09/052,780 filed on Mar. 31, 1998.

BACKGROUND OF THE INVENTION

In citizens band radio applications, antennas are shortened to less than a quarter wave length (8.5 feet at 27 MHz) by the use of a loading coil device along the transmission line radiator circuit The use of a coil, or inductive reactance, is commonly known in the art as "loading". For a given radio, the distance over which communications can be established depends upon the Q of the loading coil device. Applicant has measured the Q of different loading coil assemblies, and found them to be as shown in table 1 presented below.

TABLE 1

| COIL | Q | COIL | Q |
|---|---|---|---|
| This invention | 864 | American Pride Rolling | 280 |
| Wilson W2000 | 667 | Thunder | |
| Antron 21K | 500 | Super Penetrator | 240 |
| Terminator II (TSP-2000) | 471 | Hustler RM-11 | 234 |
| Whiskey Still Super | 442 | Halo | 210 |
| Whiskey Still Junior | 434 | K40 Trucker | 110 |
| Wonder Works 102 | 367 | Solarcon 1.2K Chrome | 80 |
| | | Solarcon Gold A-3002 | 72 |

The "Wilson W2000" is the antenna described in U.S. Pat. No. 4,882,591. It is noted that the following formulas describe Q:

Q=(2× maximum energy stored/(energy lost per cycle)

It can be seen that as Q decreases, the loss increases. It also can be shown that the Q of an inductor is:

$$Q=X_l/R$$

Where $X_L$ is the reactance of the inductor and R is its series resistance. For a given inductance, the higher the Q, the smaller the resistance lost. A loaded antenna coil assembly which had an especially high Q and which was rugged and of moderate cost, would be of value.

SUMMARY OF THE INVENTION

In accordance with one embodiment of the present invention, an antenna loading coil assembly is provided, which has an especially high Q, along with ruggedness and moderate cost. The coil assembly includes an electrically conductive wire with a coil portion of the wire wound about a primarily vertical axis, and with the wire having upper and lower portions that extend toward the axis to a coupling where they are coupled to upper and lower conductors. The inside of the coil is substantially devoid of solid material, while a frame that surrounds the coil is substantially devoid of electrically conductive material. Upper and lower wire portions that extend from opposite ends of the coil, extend largely toward the coil axis, at inclines that locate the upper and lower wire portions away from the volume directly inside the coil. Electrically conductive coupling slugs of upper and lower conductors, that are connected to the wire end portions, preferably are of small diameter. The turns of the coil are braced on one another by strips of material that are mounted on the coil turns, so a minimum amount of material lies close to the coil.

The novel features of the invention are set forth with particularity in the appended claims. The invention will be best understood from the following description when read in conjunction with the accompanying drawings.

BRIEF DESCRIPTION OF THE DRAWINGS

FIG. 3 is a side elevation view of a coil used in one of applicant's tests, where the upper and lower wire portions had an exit angle of 30°.

FIG. 4 is a view similar to that of FIG. 3, but with the exit angle being 15°.

FIG. 5 is a view similar to that of FIG. 3, but with the exit angle being 0°.

FIG. 6 is a side elevation view of a coil of the type shown in FIGS. 3–5, with an electrically conductive coupling connected to the wire end portions at each end of the coil.

FIG. 7 is a view taken along the axis of the coil of FIG. 6.

DESCRIPTION OF THE PREFERRED EMBODIMENTS

Figure 1:
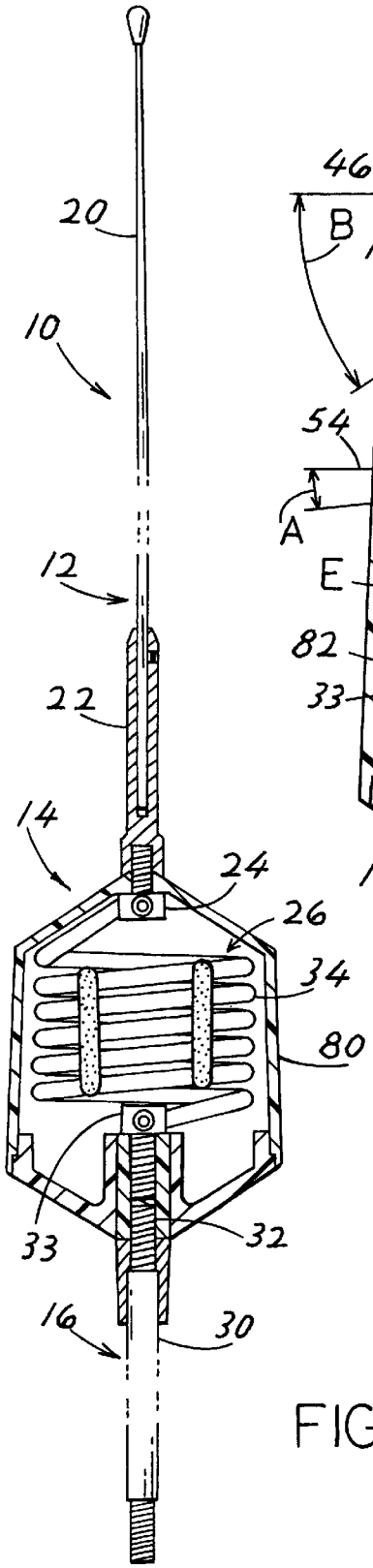
FIG. 1 is a sectional side view of an antenna constructed in accordance with one embodiment of the present invention.
Figure 2:
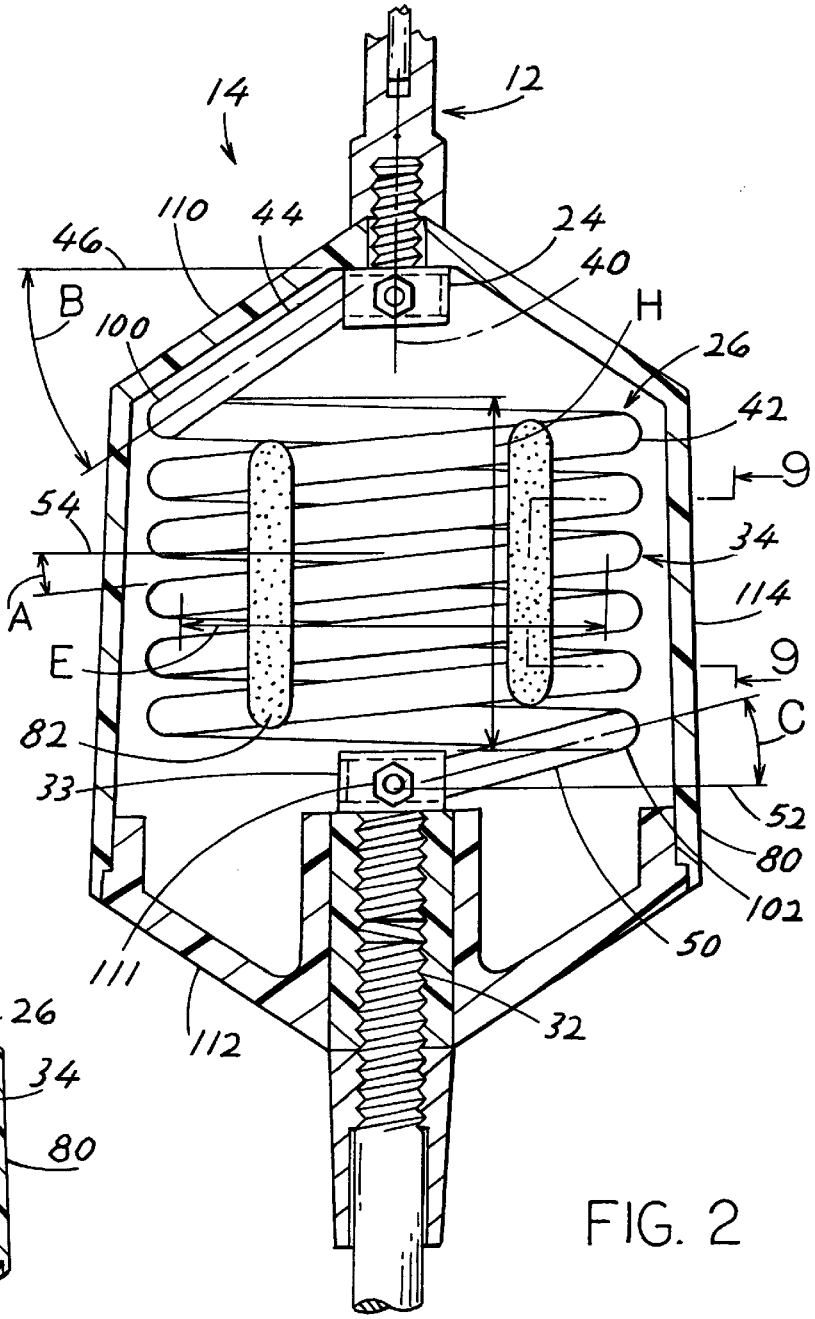
FIG. 2 is an enlarged view of a portion of the antenna of FIG. 1.

FIG. 1 illustrates an antenna 10 designed to be mounted on a vehicle, and designed for transmission and reception of radio signals of a frequency on the order of magnitude of that of citizen band radio frequencies (about 27 MHz). The antenna includes an upper conductor 12, a coil assembly 14 connected to the upper conductor, and a lower conductor 16 extending generally down from the coil assembly. The upper conductor includes a semi-flexible upper radiator 20, a mast 22, and an upper coupling slug or coupling 24 that is coupled to the top of a coil device 26 of the coil assembly. The lower conductor 16 includes a base rod 30 whose lower end is designed to mount on a vehicle, by means of an insulated mounting bracket. The lower conductor 16 also includes a metal insert 32, and a lower coupling slug or coupling 33 that is coupled to the lower end of the coil device 26. As shown in FIG. 2, the coil device 26 includes a coil 34 that is wound in a helix about a primarily vertical axis 40, with the upper conductor 12 generally extending upwardly along the same axis. The coil 34 is formed by at least three turns of an electrically conductive wire 42, with the particular coil shown having five one-half turns. The wire has an upper wire portion 44 that extends from the upper end 100 of the coil 34, at an upward incline B from a horizontal plane 46 (that is normal to axis 40). The upper wire portion extends to the upper coupling 24 that lies along the coil axis 40. The wire has a lower wire portion 50 that extends from the col 34, at a downward incline C from a horizontal plane 52, with the lower wire portion connected to the lower coupling 32 that lies along the coil axis. The exit angles B, C of the upper and lower wire portions are much greater than the wind angle A of the coil, which is the angle of the wire along the coil with respect to a horizontal plane 54 that is normal to the axis 40.

Applicant has conducted a series of experiments to determine changes in the Q of the coil assembly with changes in various parameters in the design of the coil assembly. FIGS. 3–5 illustrate three coil devices 61–63 that were tested. The coil devices 61–63 were similar to the coil device 64 of FIG. 2, but with the angles B and C of the upper and lower wire portion being varied and the resulting Q of the coil being measured. The experiments were performed when a "Q" meter was connected to opposite ends of the coil device, without any other material in close proximity to the coil. For the coil 61 of FIG. 3, the exit angles Ba and Ca at the top and bottom were both 30°. In FIG. 4 the exit angles Bb and Cb were each 15°, while in FIG. 5 the exit angles Bc and Cc were both 0°. Table 2 given below shows the change in Q with exit angle. It should be noted that there was no coupling slug attached to the upper or lower wire portion 44, 50 and no other material was in the vicinity of any coil in the tests reported in Table 2.

TABLE 2

| Exit Angles | Q |
|---|---|
| 30° (FIG. 3) | 938 |
| 15° (FIG. 4) | 927 |
| 0° (FIG. 5) | 882 |

The coils of FIGS. 3–5 were then separately tested with a center rod 70 of dielectric material extending along the axis of the rod through the coil devices, with each rod having a diameter G of 30% of the coil inside diameter E, and therefore an area of 9% of the coil inside area as viewed along the axis 40. Different dielectric center rod materials were used, and the results for different exit angles are presented in table 3 written below.

TABLE 3

| Rod Material | Q at 30° (FIG. 3) | Q at 15° (FIG. 4) | Q at 0° (FIG. 5) |
|---|---|---|---|
| Phenolic | 661 | 633 | 604 |
| ABS | 826 | 807 | 781 |
| Delrin | 841 | 827 | 805 |
| Nylon | 864 | 851 | 824 |
| Fiberglass | 884 | 870 | 842 |
| Air (no rod) | 938 | 927 | 882 |

It can be seen that a small quantity of dielectric material within the coil can greatly reduce the Q, depending upon the particular material. This test indicates that the avoidance of dielectric material within the coil is highly desirable in achieving a high Q. In other tests that applicant has conducted, it was found that the presence of electrically conductive material (instead of dielectric material) lying within the coil decreased the Q by much more than dielectric material.

Figure 8:
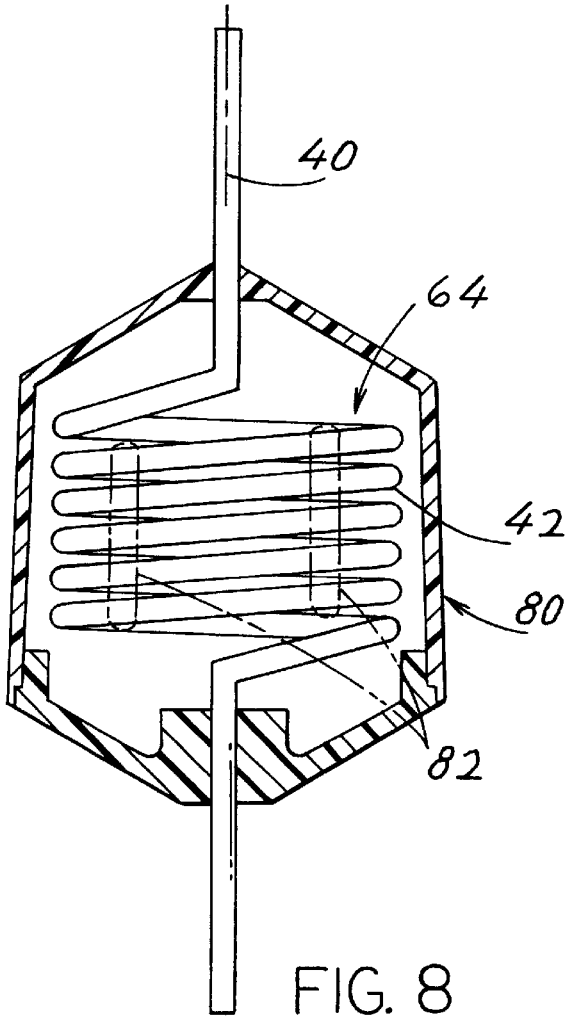
FIG. 8 is a sectional side view of one of the coils of FIGS. 3–5, shown enclosed in a dielectric frame.

Applicant's FIG. 8 shows a test set up that applicant has used to test the effects of a frame 80 around coil devices 64 of the type shown in FIGS. 3–5. The particular frame 80 was constructed of ABS plastic and had thin vertical walls (0.1 inch thick walls for coils of 2.0 inch inside diameter). Table 4 presented below, shows that the presence of the thin-walled frame around the coil device, resulted in only a moderate reduction in Q. Applicant also applied four dielectric bracing strips 82 of silicone, spaced 90° about the coil axis 40, to minimize movement of the coil turns toward and away from each other. Table 4 also shows that the silicone bracing strips reduced the Q by only a small amount.

TABLE 4

| Exit Angles | Q For Coil Without Cover | Q For Coil With Cover | Q for Coil Without Cover But With Silicone Bracing Strips |
|---|---|---|---|
| 30° (FIG. 3) | 938 | 903 | 912 |
| 15° (FIG. 4) | 927 | 891 | 899 |
| 0° (FIG. 5) | 882 | 871 | 877 |

In another series of tests, a coil of the type shown in FIG. 6 was used, with couplings, or coupling slugs 90, 92 of brass at the top and bottom of the coil as shown. Each coupling slug had a diameter F (FIG. 7) which was a fraction of the coil inside diameter E (as viewed along the axis 40), so each coupling slug occupied a small fraction of the area within the coil. In one example, the slug diameter F is 30% of the coil inside diameter E, so the slug occupies 9% of the area within the coil. The ends 94, 96 of the slug closest to the coil, were placed at varying distances from the top or the bottom of the coil 100, 102 from which the upper and lower wire portions 44, 50 extended. The numbers "−1, 0, 1, and 2" in FIG. 6 indicate the distance of the end of the coupling slug from the corresponding end of the coil, as measured by the number of wire diameters J. Table 5 given below shows the variation in Q with slug position and cross-sectional area (as viewed along the axis 40) of each slug as a percent of coil inside area (FIG. 7), for different exit angles of the wire end portions. Coupling slugs were tested whose area ($nF^2/4$) as a percent of coil inside area ($nE^2/4$) were 5%, 10%, and 15%. It can be seen that the highest Q is obtained when the adjacent ends of the coupling slugs are furthest from the coil, and when the slugs have the least diameter.

TABLE 5

| Exit Angle and Cross Sectional Area of Coupling Slug | Q for different Slug Positions −1 | 0 | 1 | 2 |
|---|---|---|---|---|
| A. 30° Exit Angle (FIG. 3) | | | | |
| 5% slug area | 838 | 856 | 867 | 862 |
| 10% slug area | 779 | 817 | 836 | 862 |
| 15% slug area | 737 | 785 | 813 | 828 |
| B. 15° Exit Angle (FIG. 4) | | | | |
| 5% slug area | 825 | 847 | 855 | 804 |
| 10% slug area | 772 | 812 | 835 | 855 |
| 15% slug area | 732 | 780 | 864 | 813 |
| C. 0° Exit Angle (FIG. 5) | | | | |
| 5% slug area | 804 | 819 | 833 | 844 |
| 10% slug area | 747 | 770 | 791 | 822 |
| 15% slug area | 698 | 756 | 780 | 809 |

As stated above, the highest Q is obtained when the adjacent ends of the coupling slugs are furthest from the coil, and when the slugs have the least diameter. Other tests were performed where metal was placed outside the coil, which was found to greatly lower the Q of the coil.

Figure 9:
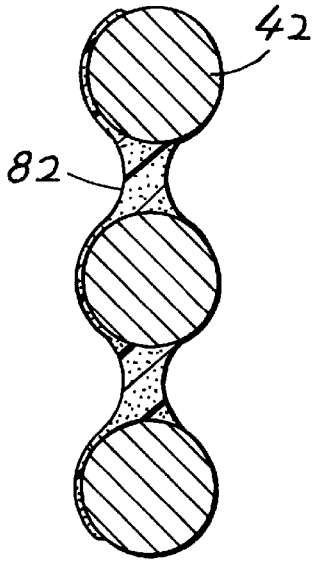
FIG. 9 is a partial sectional view taken on line 9—9 of FIG. 2.

FIG. 9 shows some details of one of the bracing strips 82 that applicant has used to brace the coil turns on one another. The strips 82 were formed of silicone adhesive which was applied in four vertical lines (each 3/16" wide) to the outside of the coil. The silicone was highly viscous as applied, and then set and bonded to the silver-plated copper material of the coil wire 42. Most of the material lay between adjacent coil turns, with little lying outside the coil and substantially none lying inside the coil. The effect of these bracing strips is shown in table 4 above. The total of one or more quantites of bracing material (four indicated in FIG. 2), has a volume no more than 2% of the volume inside the coil (II $E^2$ H/4).

The above tests show that to obtain a high Q commercially practical coil assembly 14 (FIG. 2) several steps should be taken in the design. First, substantially no material should lie within the turns of the coil 26; that is, the amount of material should be no more than a few percent (3%), and preferably no more than two percent of the volume of the inside of the coil as measured between its top and bottom 100, 102 (II $E^2$ H/4). Special pains should be taken to eliminate conductive material within the coil. The material of a frame that surrounds and protects the coil, should be of dielectric material, with substantially none (no more than about 2%) of the frame portion that lies directly (radial to axis 40) outside the coil being of electrically conductive material. Although it is possible to extend the coil upper and lower end portions upwardly and downwardly, as a practical matter metal coupling slugs, or couplings, are used. Such couplings should be of minimum diameter, so they preferably occupy no more than about 10% of the cross-sectional area of the inside of the coil as viewed along the coil axis. Also, such slugs should lie as far as practically possible from the ends of the coil.

Also, as much as possible of the wire end portions should lie far from the coil ends, which is obtained by extending the coil ends at exit angles larger than the wind angle A of the coil, and preferably more than twice or three times as much. This is achieved with an exit angle for the wire end portions of at least about 15°.

Because of the fact that an increasing exit angle increases the height of the coil assembly, applicant has chosen to use an exit angle of 30° at the top and 15° at the bottom. The amount of dielectric material in or immediately around the coil is minimized, while still providing bracing means for bracing each coil turn on another one, by providing strips of dielectric material that join the coil at a plurality of locations spaced about the coil axis. Applicant prefers to use strips of setable adhesive such as silicone. However, it would be possible to use strips of plastic with notches for dosely receiving each coil, with such strips preferably hanging on the coil but possibly fixed to the frame.

Applicant has constructed and successfully tested a coil assembly of the construction shown in FIG. 2. The wire 42 had a diameter of 0.181 inch, and the coil had an inside diameter E of 2.00 inches and a height H of 1.65 inch. The wind angle A was 6°, the exit angle B at the upper wire portion was 30°, and the exit angle C at the lower wire portion was 15°. Each of the coupling slugs 24, 32 had a diameter of 0.55 inch, so each coupling slug occupied about 8% of the cross-sectional area of the coil as viewed along the coil axis. Each coupling slug or coupling, was held to a wire by a set screw 111 and soldered in place. The frame 80 was constructed of ABS plastic, with 10 upper and lower ends 110, 112 both being conical as shown, with frame side walls 114 of 0.1 inch thickness, and with other dimensions relative to those given above being proportional as shown in FIG. 2.

Thus, the invention provides a coil assembly for a loaded antenna, where the coil assembly has an especially high Q. This is achieved by establishing substantially no solid material within the coil and substantially only dielectric material radially outside the coil. Upper and lower wire portions extend at exit angles which are greater than the coil wind angle and which are preferably more than twice as great, with each exit angle preferably being at least about 15°. Electrically conductive coupling slugs, or couplings lying beyond the opposite ends of the coil, preferably lie at least about one coil diameter beyond the coil end, with the large exit angle at the upper and lower wire portions holding the couplings away from the coil. The coil turns are braced on one another by quantities of dielectric material joined to a plurality of turns, with the bracing material preferably bonded to the turns so very little material is required. As discussed above, applicant's coil assembly of the present invention, constructed as described above, was measured to have a Q of 864, which is 27.5% greater than the Q of applicant's coil assembly described in his earlier U.S. Pat. No. 4,882,591, which previously was the highest Q coil assembly for CB radios on the market.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An antenna comprising:

an electrically conductive wire with a coil portion that is wound into a coil that includes at least three turns and that has a primarily vertical axis and upper and lower coil ends, said wire including upper and lower wire portions extending from said ends of said coil portion;

a frame of rigid dielectric material that surrounds said coil and that is spaced from said coil, said frame having upper and lower ends;

a conductive radiator device connected to said upper wire portion and mounted on said frame upper end and extending upwardly therefrom, and a base that includes a lower conductor connected to said lower wire potion and mounted on said frame lower end and extending at least partially downward therefrom;

the inside of said coil being substantially devoid of solid material, and said frame being constructed substantially only of dielectric material at locations radially outward of said coil;

said frame being a load-carrying member, with the weight of said conductive radiator device transmitted to said base primarily through said frame.

2. The antenna described in claim 1 wherein:

said lower conductor comprises a base rod that extends vertically downwardly from said frame;

said frame has conical upper and lower walls.

3. A high Q antenna comprising:

an electrically conductive wire, with a coil portion of said wire wound into a helical coil, and with said wire having upper and lower wire end portions extending from said coil, said antenna also including upper and lower conductors connected to said upper and lower wire and portions with said upper conductor having a vertical length that is a plurality of times greater than the vertical length of said coil, and with said coil and said upper wire portion each forming part of a radiator for radiating radio waves;

a base that includes said lower wire portion, said base supporting the weight of said upper conductor;

a load-carrying rigid dielectric frame which supports said upper conductor and which is supported on said base, and which lies around said coil and is spaced from said coil;

the volume within said coil is substantially devoid of solid material, and said dielectric frame is substantially devoid of electrically conductive material around said coil.

4. An antenna which includes an electrically conductive wire, with a coil portion of said wire wound into a helical coil having an axis, and with said wire having upper and lower wire end portions extending from said coil, said antenna also including upper and lower conductors connected to said upper and lower wire end portions, and upper and lower electrically conductive couplings each lying along said axis and coupling one of said wire end portions to a corresponding one of said upper and lower conductors, the improvement wherein:

the volume within said coil portion is substantially devoid of solid material;

each of said couplings occupies an area greater than the cross section of wire of said coil, but each of said couplings occupies an area, as viewed along said helix axis, which is no more than about 10% of the area within the adjacent end of said coil as viewed along said helix axis;

a solely dielectric rigid load-bearing frame that surrounds said coil portion and is spaced from it, and which is mechanically coupled to said upper conductor and which supports the weight of said upper conductor.

5. An antenna comprising:

an electrically conductive wire with a coil portion of said wire wound into a coil that includes at least three turns and an axis;

a plurality of strips of dielectric material spaced apart about said coil axis, with each strip joined to a plurality of said turns of said coil to brace each turn on an adjacent turn, and with each strip bonded to turns of said coil;

each of said strips is formed of a settable material that is applied in an unset deformable state to said coil and allowed to set to harden thereon.

6. An antenna comprising:

an electrically conductive wire with a coil portion of said wire wound into a coil that has an axis in a longitudinal direction of the coil, and includes at least three turns;

a plurality of strips of dielectric material spaced apart about said axis, with each strip joined to a plurality of said turns of said coil to brace each turn on an adjacent turn, and with each strip fixed to turns of said coil;

a frame of dielectric material surrounding said coil and spaced radially outward of said coil and of said strips, to avoid contact between said frame and said coil and between said frame and said strips.

* * * * *